US008485302B2

(12) United States Patent
Nording et al.

(10) Patent No.: US 8,485,302 B2
(45) Date of Patent: Jul. 16, 2013

(54) HOLDING DEVICE

(75) Inventors: Thomas Nording, Esslingen (DE); Joachim Hildebrand, Aichwald (DE); Arnulf Spieth, Hochdorf (DE)

(73) Assignee: J. Eberspaecher GmbH & Co. KG, Esslingen (DE)

( * ) Notice: Subject to any disclaimer, the term of this patent is extended or adjusted under 35 U.S.C. 154(b) by 134 days.

(21) Appl. No.: 13/053,852

(22) Filed: Mar. 22, 2011

(65) Prior Publication Data

US 2011/0232986 A1 Sep. 29, 2011

(30) Foreign Application Priority Data

Mar. 24, 2010 (DE) ..... 10 2010 012 663
Aug. 13, 2010 (DE) ..... 10 2010 034 313

(51) Int. Cl.
*F16M 13/00* (2006.01)

(52) U.S. Cl.
USPC ..... 180/296; 180/309; 267/140.11; 248/609; 248/610

(58) Field of Classification Search
USPC ..... 248/610, 608, 609; 180/296, 309; 267/140.11, 140.14, 140.15
See application file for complete search history.

(56) References Cited

U.S. PATENT DOCUMENTS

| | | | | |
|---|---|---|---|---|
| 4,746,104 A | | 5/1988 | Probst | |
| 5,082,252 A | | 1/1992 | Miyamoto | |
| 5,520,375 A | * | 5/1996 | Leibach et al. | 267/140.14 |
| 2002/0109280 A1 | * | 8/2002 | Baudendistel et al. | 267/140.15 |
| 2002/0175594 A1 | | 11/2002 | Kornbluh et al. | |

FOREIGN PATENT DOCUMENTS

| | | | |
|---|---|---|---|
| DE | 30 34 246 | A1 | 4/1981 |
| DE | 41 16 270 | A1 | 1/1992 |
| DE | 196 21 271 | A1 | 1/1997 |
| DE | 197 34 499 | A1 | 2/1999 |
| DE | 198 12 699 | A1 | 9/1999 |
| DE | 10 2004 001 060 | A1 | 8/2005 |
| DE | 10 2005 029 234 | A1 | 1/2007 |
| DE | 10 2006 021 641 | A1 | 11/2007 |
| DE | 600 37 433 | T2 | 12/2008 |
| EP | 1 160 428 | A2 | 12/2001 |
| FR | 2 674 800 | A1 | 10/1992 |
| FR | 2 678 221 | A1 | 12/1992 |
| JP | 2001 187 534 | A | 7/2001 |

* cited by examiner

*Primary Examiner* — Jeffrey J Restifo
*Assistant Examiner* — Erez Gurari
(74) *Attorney, Agent, or Firm* — McGlew and Tuttle, P.C.

(57) ABSTRACT

A holding device, for the holding of a component part of an exhaust system on a peripheral structure, more preferably of a vehicle equipped with the exhaust system, has a first connecting point for fastening the holding device to the component part of the exhaust system and a second connecting point for fastening the holding device to the structure. A coupling device is arranged between the connecting points which makes possible reversible relative movements between the connecting points. For improved holding function, the coupling device is configured such that in at least in one active direction the coupling device has a speed-dependent or frequency-dependent stiffness. The coupling device has a lower stiffness with slower or low-frequency relative movements than with faster or high-frequency relative movements.

17 Claims, 4 Drawing Sheets

HOLDING DEVICE

CROSS REFERENCE TO RELATED APPLICATIONS

This application claims the benefit of priority under 35 U.S.C. §119 of German Patent Application 10 2010 012 663.2 filed Mar. 24, 2010 and German Patent Application 10 2010 034 313.7 filed Aug. 13, 2010, the entire contents of each of which are incorporated herein by reference.

FIELD OF THE INVENTION

The present invention relates to a holding device for the holding of a component part of an exhaust system on a structure peripheral thereto, more preferably of a vehicle equipped with the exhaust system. In addition, the present invention relates to an exhaust system provided with such a holding device.

BACKGROUND OF THE INVENTION

During the operation of a motor vehicle vibrations can occur in an exhaust system. Such vibrations can be excited for example through the combustion engine or through road irregularities. Accordingly, so-called engine excitations and road excitations are distinguished from each other. Particularly heavy components of the exhaust system, such as a catalytic converter or a particle filter, are decisive to the vibration behaviour because of their greater mass. In addition, the engine-induced vibration excitation is introduced into the vibration system, that is the exhaust system, via components fixed to the combustion engine of the vehicle, for example to the engine housing and/or to the transmission housing, so that components of the exhaust system near the engine are subjected to a significantly more intensive vibration excitation than components distant from the engine. In order to now support such a component on the periphery of the exhaust system, that is on the peripheral structure of the vehicle, a holding device of the type mentioned at the outset can be employed. Said holding device can be fastened to a component part of the exhaust system with the help of a first connecting point and to the respective structure of the vehicle with a second connecting point. When using such a holding device the fact that the respective component part of the exhaust system has to be able to move relative to the adjacent structure of the vehicle in order to be able to offset thermal expansion effects is problematic. If a holding device, which for offsetting such thermal heat expansions possesses an adequate elasticity, is used, this regularly also allows undesirable component vibrations.

Such vibrations or relative movements constitute a major mechanical loading of the components concerned, that is particularly the exhaust system, the vehicle structure and the holding device.

SUMMARY OF THE INVENTION

The present invention deals with the problem of stating an improved embodiment for a holding device of the type mentioned at the outset or for an exhaust system equipped with such, which is more preferably characterized in that the risk of damaging the respective component or component part or of the respective structure or of the holding device is reduced.

According to a first solution the invention is based on the general idea of equipping the holding device with a coupling device which allows reversible relative movements between the two connecting points of the holding device, yet has a stiffness that is dependent on the velocity or the frequency of the relative movements. In the case of slow or low-frequency relative movements the coupling device has a relatively low stiffness. In the case of faster or high-frequency relative movements the coupling device in contrast has a relatively high stiffness. A slow relative movement is present for example if the component relative to the structure moves with less than 1 cm/s. Low-frequency relative movements are vibrations with a vibration frequency of less than 1 Hz. Accordingly, fast relative movements are present if the component relative to the structure moves with more than 1 cm/s. Accordingly, high-frequency vibrations are likewise present if the component relative to the structure moves with a vibration frequency of more than 1 Hz. The terms "slow", "fast", "low-frequency" and "high-frequency" are to be mainly understood relative to one another. In addition, in accordance with the preceding numerical data, they can also be understood absolutely. In addition, the terms "lower stiffness" and "greater stiffness" have to be understood relative to each other. In the case of a lower stiffness the holding device counteracts the relative movement with comparatively low forces. In the case of a greater stiffness the holding device counteracts the relative movement with comparatively large counter-acting forces.

On the one hand, the design introduced here makes possible slower or low-frequency movements as for example occur based on thermal expansion effects. On the other hand, the holding device impedes or dampens the faster or high-frequency relative movements which for example develop during the operation of the vehicle through the engine-induced and/or road-induced vibration excitation of the respective component part of the exhaust system.

Particularly advantageous according to the invention is an embodiment wherein the coupling device comprises at least two coupling elements acting in series, of which the one allows slower or low-frequency relative movements substantially force-free, while the other counteracts faster or high-frequency relative movements. The slower or low-frequency relative movements are triggered through thermal expansion effects and are made possible force-free through the one coupling element, so that substantially no stresses develop within the exhaust system. The engine-induced or road-induced vibration excitations compared with thermal expansion effects lead to faster or high-frequency relative movements, which are then counteracted by the other coupling element with corresponding forces. The other coupling element then acts for example as damper and/or spring. Also conceivable is an active coupling element which counteracts the faster or high-frequency relative movements as absorber, that is with counter-acting vibrations.

According to an advantageous embodiment the coupling device can comprise at least one hydraulic or pneumatic damper or be formed by such. The damper contains a damping fluid which upon a relative movement between the two connecting points is displaced from a first chamber of the damper into a second chamber of the damper. To this end, the two chambers are connected with each other via a throttling point. The fluid passage from the one chamber into the other chamber in the case of low flow rates is possible almost without resistance, while with large flow rates the throttle becomes effective, in this way braking or throttling the fluid flow. Accordingly, such a throttled damper acts softly for slow movements while it is hard relative to fast movements.

With an alternative configuration the coupling device can comprise at least one elastomer body consisting of an electroactive polymer, whose elasticity is variable by applying an electric voltage, and which is connected to an electric control circuit which comprises a vibration sensor for sensing vibrations of the component or component part and a control for changing the elasticity of the elastomer body as a function of the vibration frequency. With this embodiment, an elastomer body is thus used whose elasticity can be changed as a function of an electric voltage applied to it. Through this it is possible for example in the case of component vibrations whose vibration frequency is below a predetermined switching frequency, to leave the elastomer body currentless, as a result of which it possesses a comparatively high elasticity and has a soft damping characteristic. As soon as the component vibrations reach a vibration frequency above the predetermined switching frequency, however, a predetermined electric voltage is applied to the elastomer body as a result of which its elasticity changes, namely diminishes. As a consequence, a harder damping characteristic is obtained.

With a simplified embodiment the control does not work together with a vibration sensor but with a family of characteristics in which the elasticity to be set is stored as a function of the rotational speed of the combustion engine. To this end, the control can communicate with a suitable engine control unit of the combustion engine. The rotational speed of the combustion engine correlates to the engine-induced vibration excitation so that the setting of the frequency-dependent elasticity in this case can be realized with a simplified control effort.

With a simple embodiment the control can switch the two states described above, namely switching off the predetermined voltage and switching on the predetermined voltage. With a more comfortable embodiment it can be provided to vary the voltage on the elastomer body in several steps in order to be able to thus change the elasticity of the elastomer body in a stepped manner. For example, several different switching frequencies, which trigger a step-by-step increase of the voltage applied to the elastomer body, can be predetermined for this purpose. In addition to this it is likewise possible to steplessly vary the voltage on the elastomer body as a function of the measured component vibration frequency, as a result of which a proportional association between component frequency and elasticity of the elastomer body and ultimately stiffness of the coupling device can be realized. The proportionality concept in this case can be degressive or progressive or linear.

Alternatively it is likewise possible to vary the elasticity of the elastomer body with the vibration frequency, so that elasticity vibrations develop in the elastomer body. According to this embodiment, changing does not take place statically between two or several states of the elastomer body but dynamically, that is with the frequency of the component vibrations. According to this embodiment, it can be particularly advantageous to provide a phase shift relative to the component vibrations between the actuation vibrations, which are excited in the elastomer body with the help of the control in such a manner that a reduction of the vibration amplitudes on the component materializes. As a result of this, quasi anti-vibrations are generated on the holding device, which lead to an effective damping of the component vibrations.

According to another advantageous embodiment the coupling device can comprise a dilatant material for the movement transmission between the two connecting points. A dilatant material is characterized by an elasticity that depends on the velocity of the force introduction, in the case of a solid body, or viscosity, in the case of a fluid. A kneadable dilatant mass for example exists which, when thrown to the ground, rebounds like a rubber ball and which, if struck by a hammer, breaks like a ceramic body. The applicant has recognised that such a dilatant material is highly suitable in order to realize a velocity-dependent or frequency-dependent stiffness with a coupling device. In the case of high-frequency faults the dilatant material reacts in a hard fashion and shows a high stiffness. In the case of slow faults it reacts in a soft fashion and can be deformed, specifically—depending on the embodiment—elastically or plastically, more preferably, however, reversibly.

Acting in parallel with the dilatant material at least one spring element can be provided in order to generate a corresponding resetting force in the event of a change in shape of the dilatant material. With low-frequency or slow adjusting movements this arrangement of dilatant material and at least one spring element acts like a spring. With fast or high-frequency adjusting movements, this arrangement of dilatant material and at least one spring element acts like a solid body.

For example, the coupling device can comprise a piston-cylinder unit whose cylinder is connected in a fixed manner with the one connecting point and whose piston is connected in a fixed manner to the other connecting point. In the cylinder, a chamber is contained in which the piston is moveable. This chamber is filled with the dilatant material, which in this case can be a liquid or pasty or solid dilatant material. With slow movements of the piston in the cylinder a comparatively low viscosity or stiffness is present, so that the piston can move in the cylinder almost free of resistance. With rapid movements, the viscosity or stiffness increases as a result of which the resistance which the dilatant material offers to the relative movement between cylinder and piston increases correspondingly.

With another embodiment the coupling device can comprise a flexurally elastic sheet metal part or be formed by such. This sheet metal component at least comprises one closed hollow space in which a free-flowing granulate is arranged. There, the volume filled by the granulate is smaller than the total volume of the hollow space. With this embodiment, relative movements between the connecting points result in elastic deformations of the sheet metal part. With low-frequency relative movements the granulate can follow the movements of the sheet metal part. With high-frequency relative movements a movement excitation also takes place in the granulate, which absorbs energy from the vibration system, that is converts energy from the vibration system into heat and thus brings about a damping of the vibration.

According to a second solution the general thinking of the invention is based on the idea of realizing the coupling device by means of at least one electric actuator. An associated electric control circuit comprises the respective actuator, at least one vibration sensor for sensing vibrations of the component as well as at least one control for actuating the actuator as a function of the vibration frequency. The actuator can now change a spacing between the connecting points as a function of its actuation. With the help of such an actuator the coupling device can counteract relative movements between component and structure to a greater or lesser degree. For example, low-frequency relative movements can be realized with little resistance while high-frequency relative movements can only be realized against increased resistance and even against movements directed in opposite direction.

According to an advantageous embodiment the control can excite the respective actuator with the vibration frequency with which the component vibrates. It is particularly practical here to realize the actuator vibrations with respect to the component vibrations with a phase shift that is selected so that a reduction of the vibration amplitudes materializes on the component. Here, the coupling device operates like an anti-vibration generator, which effectively reduces the vibration amplitudes of the component. In the ideal case, even a vibration cancellation can be realized. The coupling device in this case is operated analogously to an anti-sound generator which in an active sound damping system cancels or reduces vibration amplitudes to be damped by means of phase-shifted anti-sound.

Here it is particularly advantageous if the actuator is equipped with an electroactive polymer, which changes its shape through the application of an electric voltage. Because of this, the actuator can be realized particularly cost-effectively. In particular, the electroactive polymer can be realized in a wide range of geometrical shapes. Alternatively, a piezo-actuator can also be used.

It is to be understood that the features mentioned above and still to be explained in the following cannot only be used in the respective combination stated, but also in other combinations or by themselves, without leaving the scope of the present invention.

Preferred exemplary embodiments of the invention are shown in the drawings and will be explained in more detail in the following description, wherein same reference characters refer to same or similar or functionally same components. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
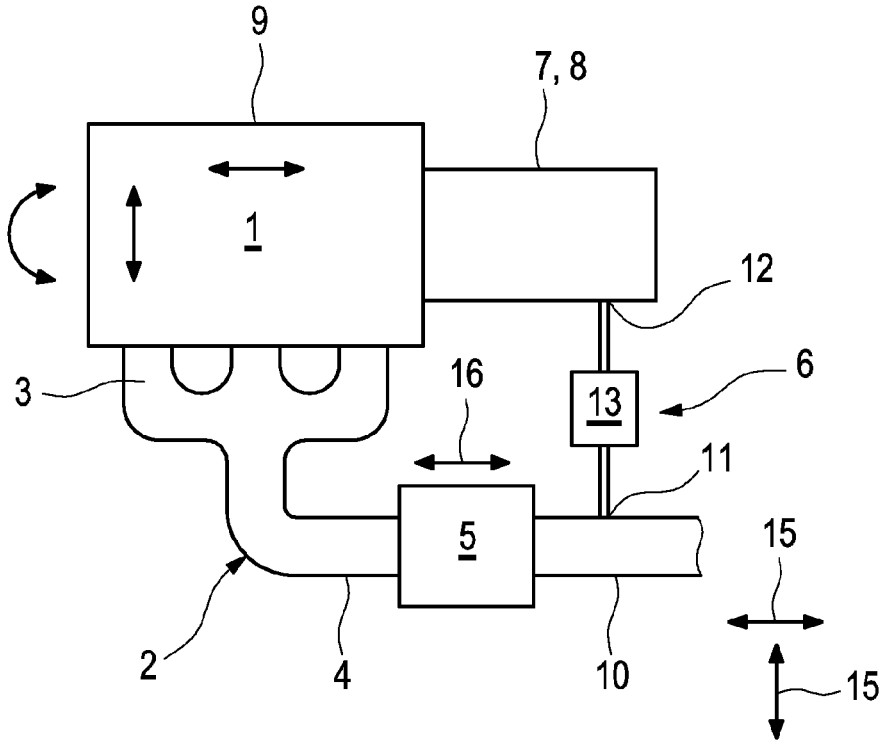
FIG. 1 is a greatly simplified circuit diagram-like schematic representation of a combustion engine with exhaust system.

According to FIG. 1, a combustion engine 1 in the usual manner comprises an exhaust system 2 which for example via an exhaust manifold 3 or elbow 3 is connected to the combustion engine 1. The exhaust system 2 comprises an exhaust pipe 4 that is connected to the elbow 3 and leads away the exhaust gas collected there. The exhaust system 2 in the usual manner comprises at least one exhaust gas treatment device 5 which is incorporated in the exhaust pipe 4. In the example of FIG. 1 only such an exhaust gas treatment device 5 which is incorporated in the exhaust pipe 4 relatively closely to the combustion engine 1, is shown. The exhaust gas treatment device 5 for example is a catalytic converter. It can likewise also be a particle filter.

The exhaust system 2 is held or positioned or supported on its periphery with the help of a holding device 6. For example, the holding device 6 for this purpose interacts with a peripheral structure 7 of a vehicle, in which the combustion engine 1 is arranged. The peripheral structure 7 in the example of FIG. 1 is a transmission housing 8 of a transmission connected to the combustion engine 8. The holding device 6 can likewise be connected to an engine block 9 of the combustion engine 1. In addition, a body of the vehicle can also serve as support for the holding device 6. With the help of the holding device 6 a component part 10 or component 10 of the exhaust system 2 can now be held on said structure 7. In the example of FIG. 1 the component 10 or the component part 10 is formed through a portion of the exhaust pipe 4, which is fastened to the vehicle with the help of the holding device 6. This pipe portion 10 in this case is positioned downstream of the exhaust gas treatment device 5. However, the mentioned connecting points are purely exemplary.

Figure 2:
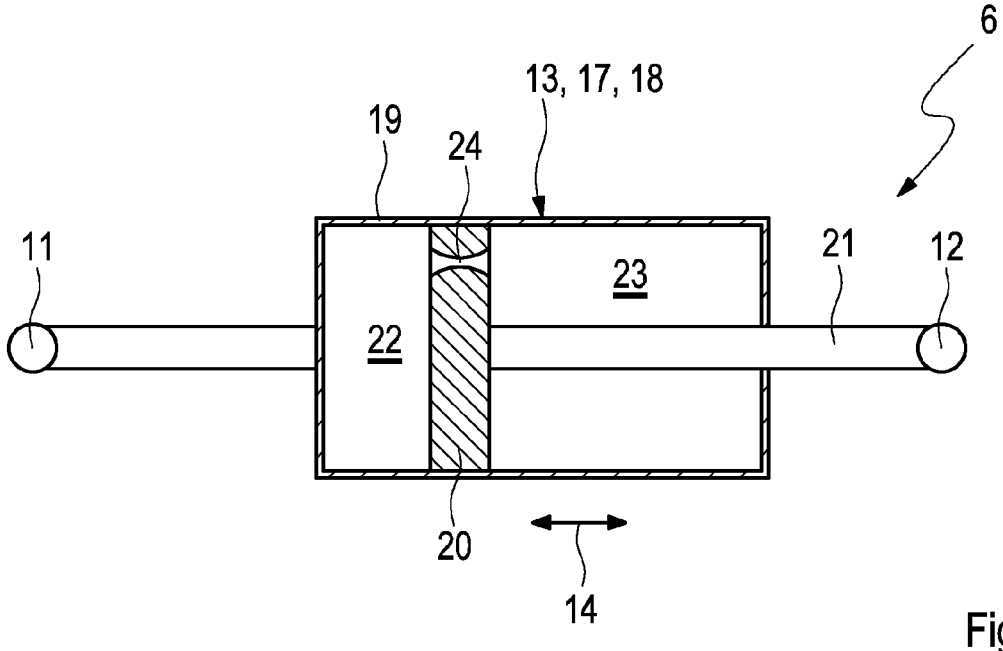
FIG. 2 is a greatly simplified schematic representation of a holding device.
Figure 3:
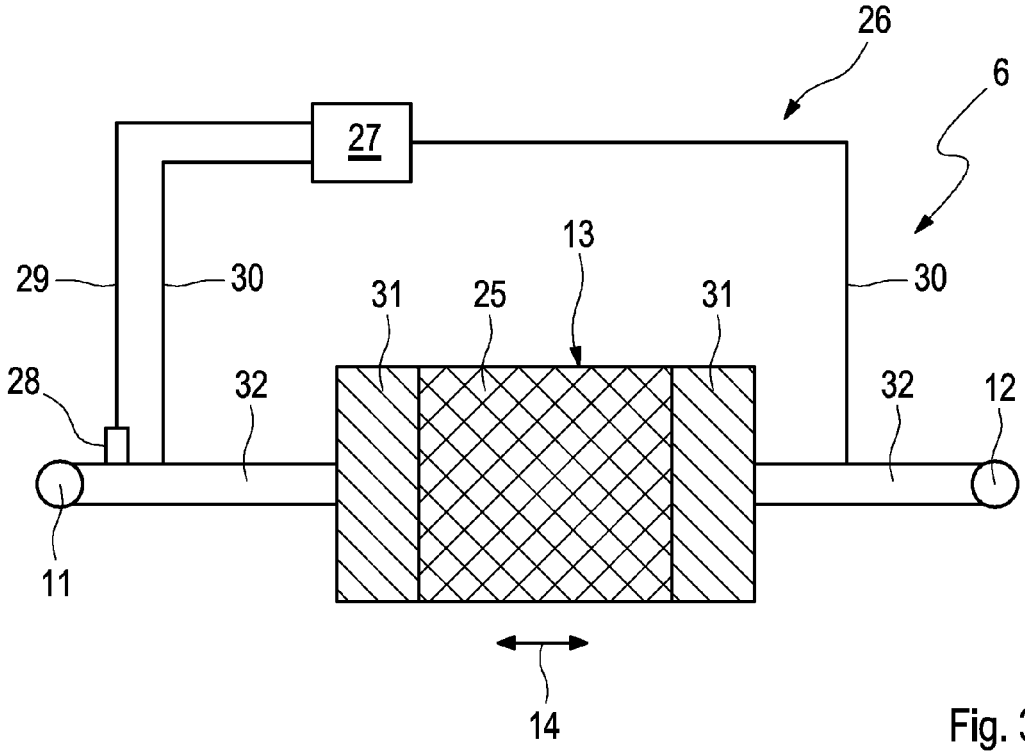
FIG. 3 is a view as in FIG. 2, however showing another embodiment.

According to FIGS. 2 and 3 the respective holding device 6 comprises a first connecting point 11 with the help of which the holding device 6 can be fastened to the respective component part 10 of the exhaust system 2, and a second connecting point 12, with which the holding device 6 can be fastened to the respective peripheral structure 7. In addition, the holding device 6 comprises a coupling device 13 arranged between the connecting points 11, 12. This coupling device 13 is configured such that it makes possible reversible relative movements between the connecting points 11, 12. Such relative movements can for example take place in an active direction 14 indicated in FIGS. 2 and 3 through a double arrow.

According to FIG. 1, the exhaust system 2 in the region of the first connecting point 11 during the operation of the combustion engine 1 can be excited to vibrations whose vibration directions in FIG. 1 are indicated through double arrows and designated 15. Here, longitudinal vibrations and transverse vibrations are shown. Rotary vibrations are likewise conceivable. In addition to these high-frequency or fast relative movements between the respective component part 10 of the exhaust system 2 and the structure 7 that is stationary with respect to the latter, slow or low-frequency relative movements can also occur between these components. For example, the thermal expansion of the exhaust system 2 in operation can result in a shift of the first connecting point 11 relative to the combustion engine 1 and thus relative to the structure. An active direction of the thermal expansion is indicated in FIG. 1 through a double arrow and designated 16.

According to a first solution according to the invention the coupling device 13 can be configured so that it has a speed-dependent and/or frequency-dependent stiffness at least in its active direction 14. This results in that the stiffness of the coupling device 13 with slow relative movements between the connecting points 11, 12 or with low-frequency relative movements between the connecting points 11, 12 has a comparatively low stiffness, while with faster or high-frequency relative movements between the connecting points 11, 12 it has a relatively high stiffness. The slow or low-frequency relative movements as a rule are the relative movements triggered by the thermal heat expansion 16. In contrast with this, the faster or high-frequency relative movements are vibrations 15 of the exhaust system 2 which occur during the operation of the combustion engine 1 in the region of the respective component part 10 of the exhaust system 2.

In the present connection, the stiffness is understood to be the reciprocal of the elasticity, so that a high stiffness coincides with a low elasticity, while a high elasticity leads to a low stiffness.

Such a coupling device 13 with speed-dependent and/or frequency-dependent stiffness can be realized in different ways. For example, FIG. 2 shows a solution wherein the coupling device 13 comprises a hydraulic or pneumatic damper 17 or is formed by such a damper 17. Said damper 17 in the example is realized through a piston-cylinder unit 18 which comprises a cylinder 19 and a piston 20, which by means of a piston rod 21 is led out of the cylinder 19.

The piston 20 in the cylinder 19 separates two spaces 22, 23 which are interconnected through a throttling point 24. Through this throttling point 24 fluid, upon a piston movement in the cylinder 19, can overflow from the one chamber 22 into the other chamber 23. Dependent on the speed of the piston movement a more or less intensive throttling effect occurs. The hydraulic fluid can be liquid or gaseous or pasty.

Within the piston-cylinder unit 18, cylinder 19 and piston 20 as well as the chambers 22 and 23 can principally have any cross sections. For example, round cross sections such as for example circular, elliptic or oval cross sections can be considered just as angular cross sections, such as triangular, quadrangular, hexagonal and orthogonal cross sections. However, circular cross sections are preferred.

FIG. 3 shows another embodiment of the coupling device 13 which comprises at least one elastomer body 25 consisting of an electroactive polymer. Such an electroactive polymer changes its elasticity through the application of an electric voltage. The holding device 6 in this case additionally comprises an electric control circuit 26 for actuating the elastomer body 25. The control circuit 26 to this end comprises a control 27 and a vibration sensor 28. The vibration sensor 28 can sense vibrations of the component part 10 of the exhaust system 2 and feed these to the control 27 via a signal line 29. The control 27 is connected to the elastomer body 25 or to the electroactive polymer via control lines 30. In the example, the elastomer body 25 is arranged between two plates 31, more preferably connected to these in a fixed manner, for example glued or vulcanized. The plates 30, 31 are in connection with the connecting points 11, 12 via connecting element 32. The connecting elements 32 and the plates 31 in this case serve as connecting electrodes in order to connect the control lines 30 to the elastomer body 25 or to the electroactive polymer.

The control 27 can now change the elasticity of the elastomer body 25 as a function of the sensed vibration frequency. Changing the elasticity of the elastomer body 25 can for example be varied in at least two steps. A stepless adaptation of the elasticity can likewise be realized. In addition, the control 27 can be configured or programmed so that the elasticity of the elastomer body 25 varies with the sensed vibration frequency. It is more preferably possible here to shift the elasticity vibrations relative to the component vibrations with respect to their phase, namely more preferably in such a manner that a reduction of the vibration amplitudes materializes on the respective component 10 as a result. The respective component 10 is the component part 10 which is supported with the help of the holding device 6. In the example of FIG. 1 the component 10 is the exhaust pipe 4 or the pipe portion 10.

The control 27 works with a low-pass filter, so that the slow, low-frequency heat expansions do not trigger any reaction by the control 27, namely activating the elastomer body 25. Optionally, it can be additionally provided that the control 27 takes into account thermally-induced expansion effects which likewise result in relative movements by means of a special characteristic curve in which the thermally-induced relative movements are plotted as a function of the current component temperature. To this end, the control 27 can interact with a corresponding temperature sensor. In this manner, the slow relative movements can be superimposed over the fast relative movements. Alternatively, it is likewise possible that for the separate consideration of the thermally-induced relative movements on the one hand and the relative movements generated through the component vibrations on the other hand, at least two separate coupling elements are provided within the coupling device 13, which act in series. For example, two elastomer bodies 25 whose elasticities can be changed independently of each other with the help of the control 27 are then provided. Thus, more preferably via a corresponding activation of the one elastomer body 25 the thermally-induced expansion can be permitted almost force-free, while with the help of the second elastomer body 25 the vibration excitation can be counteracted as a function of frequency with corresponding counter-acting forces.

Figure 4:
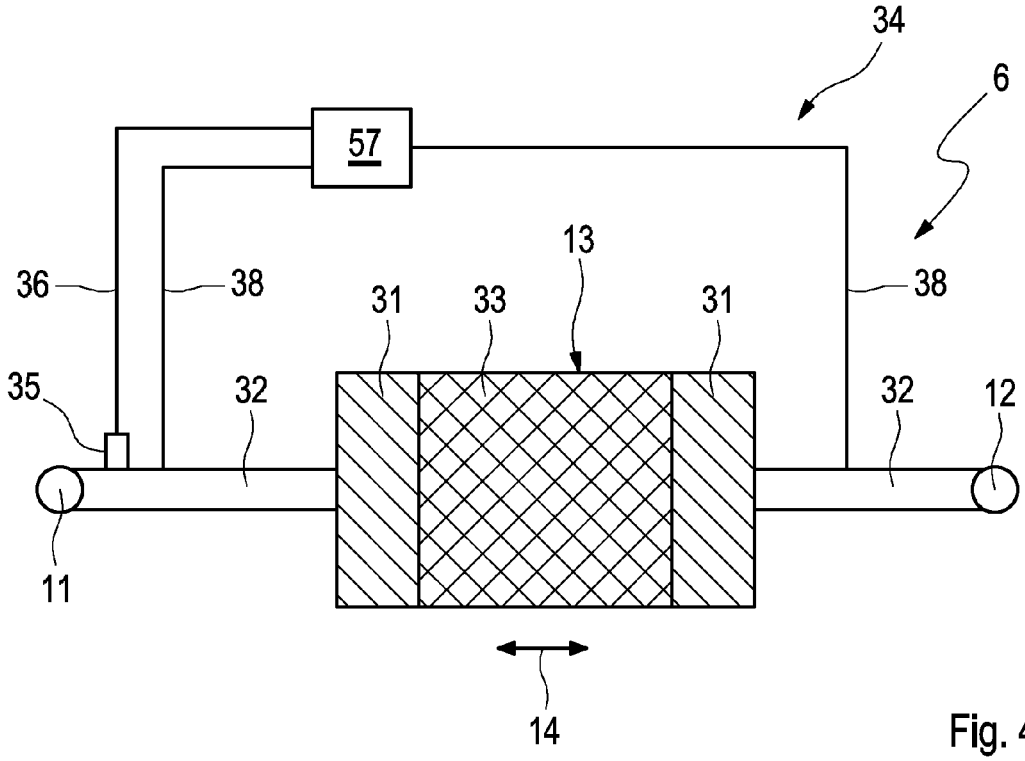
FIG. 4 is a view as in FIG. 3, however showing an alternative embodiment.

With a second solution according to the invention, which is shown in FIG. 4, the coupling device 13 can comprise at least one electric actuator 33 or be formed by such. In addition, the holding device 6 in this case comprises an electric control circuit 34 for actuating the actuator 33. This control circuit 34 comprises a vibration sensor 35 with the help of which vibrations of the respective component 10 can be sensed. A signal line 36 feeds the sensed vibrations to a control 57. Control lines 38 connect the control 57 to the actuator 33. The actuator 37 in the example has two plates 31 which are connected to the two connecting points 11, 12 via a connecting element 32 each. An actuation of the actuator 33 results in a change of the spacing between the two connecting points 11, 12. Thus, the control 57, as a function of the determined vibration frequency, can activate the actuator 33 for changing the spacing between the connecting points 11, 12. Of particular advantage is an embodiment wherein the actuator 33 is equipped with an electroactive polymer which changes its shape through the application of an electric voltage. Thus, through the application of an electric voltage the shape of the polymer can be specifically changed and thus more preferably the spacing between the connecting points 11, 12, varied.

The control 57 can be preferably configured or programmed such that it excites the actuator 33 to vibrations with a frequency which corresponds to the frequency determined with the help of the vibration sensor 35. It is now particularly advantageous to phase-shift the actuator vibrations with respect to their vibration amplitudes relative to the determined component vibrations. This phase shift is specifically conducted so that on the respective component a reduction of the vibration amplitudes materializes. The actuator 33 in this case is operated like an active silencer for structure-borne sound. It operates quasi with anti-vibrations or countervibrations which at least partially cancel the vibrations of the component 10 to be damped.

The control 57 operates with a low-pass filter so that the slow, low-frequency heat expansions do not trigger any reaction of the control 57, namely an activation of the actuator 33. Optionally, it can be additionally provided that the control 57 takes into account thermally-induced expansion effects which likewise result in relative movements by means of a special characteristic curve in which the thermally-induced relative movements are plotted as a function of the current component temperature. To this end, the control 57 can be coupled with a corresponding temperature sensor. In this manner, the slow relative movements can be superimposed over the fast relative movements. Alternatively it is likewise possible that for the separate consideration of the thermally-induced relative movements on the one hand and the relative movements generated through the component vibrations on the other hand at least two separate coupling elements are provided within the coupling device 13, which act in series. For example, two actuators 33, whose actuating movements can be changed independently of each other with help of the control 57, are then provided. Thus, the thermally-induced expansion can then be permitted almost force-free particularly via a corresponding activation of the one actuator 33, while with the help of the second actuator 33 the vibration excitation can be counteracted with corresponding counteracting forces as a function of frequency.

Figure 5:
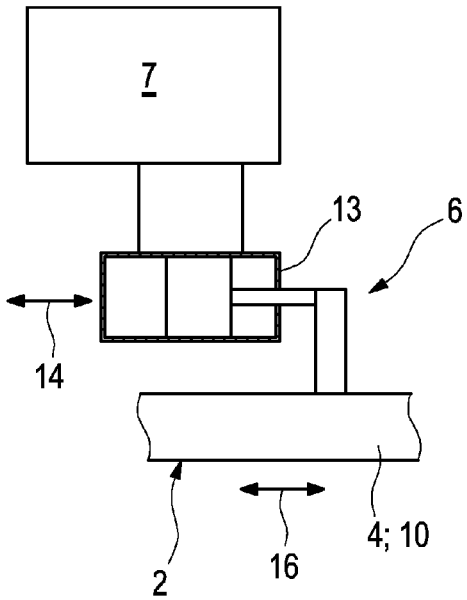
FIG. 5 is a view as in FIG. 1 showing a holding device of a further embodiment.

According to FIG. 5, an assembly for the holding device 6 can be preferentially realized which results in that the active direction 14 of the holding device 6 or the coupling device 13 runs largely parallel to the heat expansion direction 16, in which the respective component of the exhaust system 2, in this case the exhaust pipe 4 or the pipe portion 10 moves relative to the structure 7. For such an application the configuration of the coupling device 13 with frequency-dependent stiffness or as actuator is of special interest.

Figure 6:
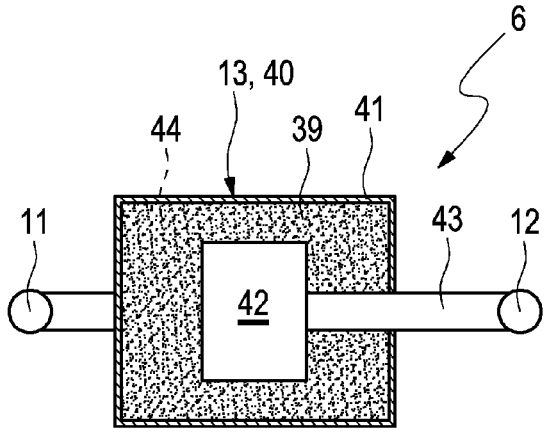
FIG. 6 is a sectional view showing an additional embodiment of holding devices.

FIG. 6 shows a further embodiment for a coupling device 13 with frequency-dependent or speed-dependent stiffness. With this embodiment, the coupling device 13 comprises a dilatant material 39. This is a plastic which reacts differently to force introduction dependent on the speed with which the force introduction takes place. This dilatant material 39 can be a liquid or a solid body. In the case of a liquid dilatant material the viscosity changes with the force introduction speed. With a solid dilatant material the elasticity changes with the force introduction speed. In the case of slow force introduction, the dilatant material is low-viscous or highly elastic. In the case of fast force introduction its viscosity grows substantially or has an extremely high stiffness.

The dilatant material 39 in this case is arranged within the coupling device 13 so that it serves for the movement transmission between the two connecting points 11, 12. In other words a relative movement between the two connecting points 11, 12 is only possible when within the coupling device 13 the dilatant material 39 is deformed or displaced.

In the example of FIG. 6, the coupling device 13 again comprises a piston-cylinder unit 40 having a cylinder 41, a piston 42 and a piston rod 43, which is connected to the piston 42 and leads out of the cylinder 41. The one connecting point 11 is connected to the cylinder 41 in a fixed manner, while the other connecting point 12 via the piston rod 43 is connected to the piston 42 in a fixed manner. The piston 42 is adjustable in a working space 44 of the cylinder 41, in which the dilatant material 39 is also located. Here, the piston 42 need not be laterally guided in the cylinder 41. Particularly in the case of a dilatant material 39 designed as solid body the piston 42 can be embedded in the dilatant material 39. With slow movements the piston 42 can be moved within the dilatant material 39 relative to the cylinder 41. However, if fast movements are to be carried out, this is extremely counteracted by the dilatant material 39.

With another embodiment the dilatant material 39 can also be moulded to an elastomer body. Then, a construction as in FIG. 3 can be basically realized without a control circuit 26 being required in such a case. Particularly in the event that the dilatant material 39 is present in the form of an elastomer body at least one spring element can be optionally arranged in such a manner that it acts parallel to the elastomer body. Such a spring element can more preferably be integrated or embedded in the elastomer body. With slow relative movements only the spring force is substantially active, which drives the components coupled together with the help of the coupling device 13 into a starting position. With fast relative movements, the dilatant material 39 then leads to a blocking of the movement or to a severe damping, which superimposes the spring force.

Figure 7:
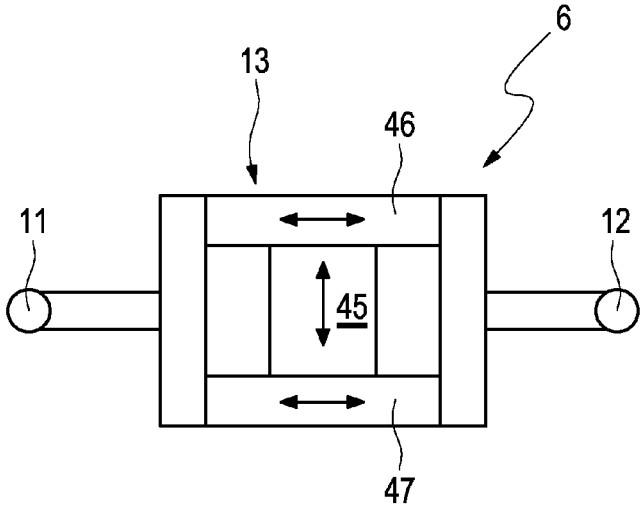
FIG. 7 is a sectional view showing an additional embodiment of holding devices.

FIG. 7 shows a further embodiment for a coupling device 13 having several elastomer bodies 45, 46 and 47. These elastomer bodies 45, 46, 47 in this case can consist of an electroactive polymer, however be variously arranged with respect to their active direction. For example, the active direction of the middle elastomer body 45 stands perpendicularly to the active directions of the two outer elastomer bodies 46, 47. Instead of elastomer bodies of electroactive polymer electric actuators can also be provided in this case. Through the provision of such an arrangement of several electroactive elastomer bodies or electric actuators, differently oriented relative movements can be dampened with the help of the holding device 6.

Figure 8:
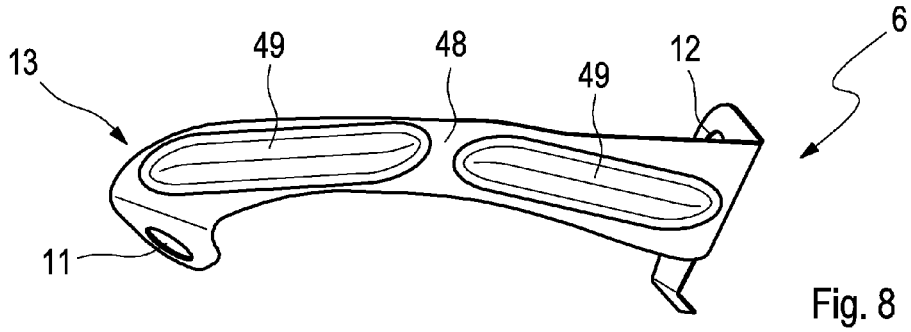
FIG. 8 is a perspective view of a further holding device.
Figure 9:
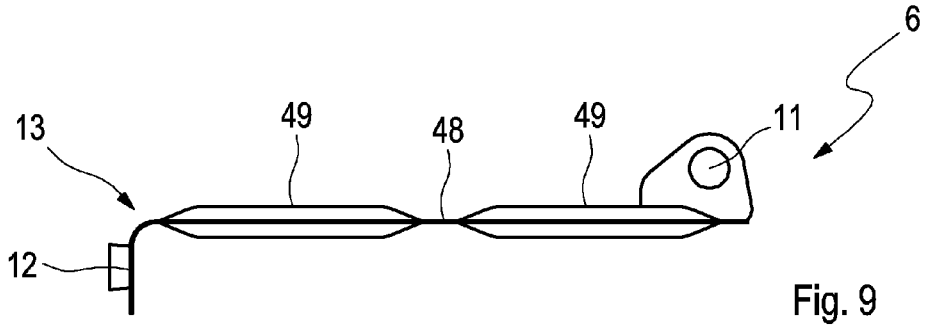
FIG. 9 is a side view of the further holding device.
Figure 10:
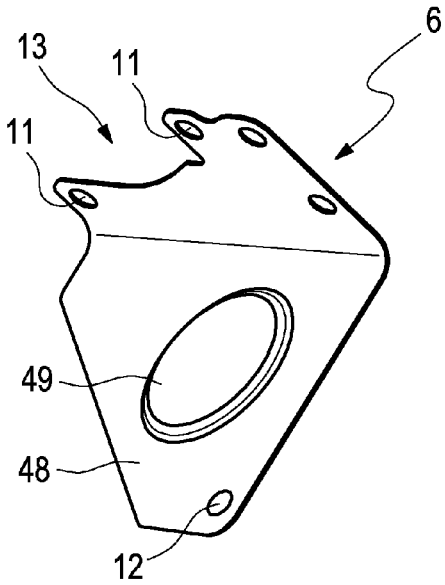
FIG. 10 is a perspective view of another further holding device as in the Figure however with another design.
Figure 11:
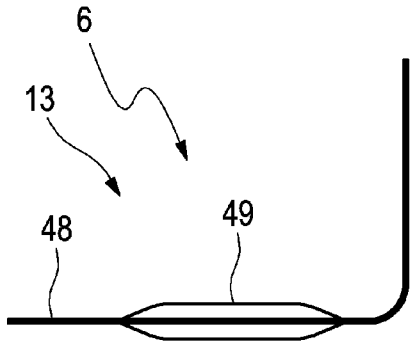
FIG. 11 is a side view of the other further holding device as in the FIG. 9, however with another design.
Figure 12:
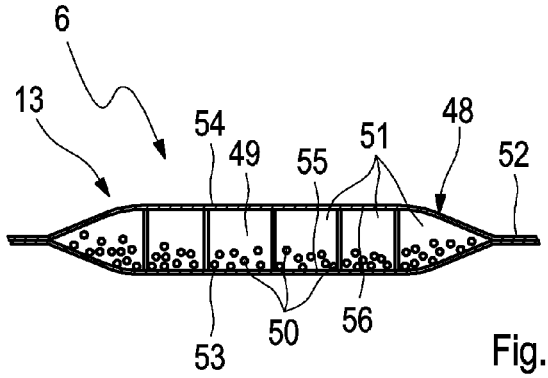
FIG. 12 is a cross sectional view of the holding device of the FIGS. 8 to 11 in the region of a hollow space.

With respect to FIGS. 8 to 12 a further embodiment for a coupling device 13 or for the holding device 6 is explained in more detail, wherein FIGS. 8 and 9 show a first design, while FIGS. 10 and 11 reflect a second design. FIG. 12 shows a sectional representation which in principle applies to both designs of FIGS. 8 to 11.

According to FIGS. 8 to 12 the coupling device 13 comprises a flexurally elastic sheet metal part 48. With the embodiments shown here quasi the entire holding device 6 is formed by this flexurally elastic sheet metal part 48. Said sheet metal part 48 comprises at least one closed hollow space 49 in which according to FIG. 12 a free-flowing granulate 50 is arranged. Here it is evident that the volume filled by the granulate 50 is smaller than the total volume of the respective hollow space 49. This results in that the granulate 50 can move in the hollow space 49. With the special embodiment shown in FIG. 12 several chambers 51 are formed in the hollow space 49, which on the one hand restrict the movement of the granulate 50 within the hollow space 49 to the individual chambers 51 and on the other hand result in a transverse stiffening of the sheet metal body 48. For example, the chambers 51 can be configured honeycomb-shaped.

The hollow chambers 49 can be realized in the sheet metal part 48 for example in that the respective sheet metal part 48 at least in the region of the respective hollow space 49 is formed as a double sheet metal structure 52, which in turn is indicated in FIG. 12. Within the respective double sheet metal structure 52, two individual metal sheets 53, 54 are provided, each of which have a depression 55 and 56 respectively, which in the assembled state complement each other mirror-symmetrically to the respective hollow space 49. The sheet metal parts 48 with the examples shown here have connecting points 11 and 12 at their ends distant from each other.

While specific embodiments of the invention have been shown and described in detail to illustrate the application of the principles of the invention, it will be understood that the invention may be embodied otherwise without departing from such principles.

What is claimed is:

1. A holding device for the holding of a component part of an exhaust system on a vehicle equipped with the exhaust system, the holding device comprising:

a first connecting point for fastening the holding device to the component part of the exhaust system;

a second connecting point for fastening the holding device to a structure; and a coupling device arranged between the connecting points, wherein the coupling device makes possible reversible relative movements between the connecting points, the coupling device having a speed-dependent and/or frequency-dependent stiffness in at least one active direction to provide the coupling device with having a lower stiffness with slower or low-frequency relative movements than with faster or high-frequency relative movements, wherein the coupling device comprises a first coupling element and a second coupling element acting in series, the first coupling element permits slower or low-frequency relative movements substantially force-free and the second coupling element counteracts faster or high-frequency relative movements.

2. A holding device according to claim 1, wherein the coupling device comprises at least one of a hydraulic damper and a pneumatic damper.

3. A holding device according to claim 1, wherein the coupling device comprises:

an elastomer body consisting of an electroactive polymer having an elasticity that is variable through the application of an electric voltage; and an electric control circuit having a control and being connected to the elastomer body for varying of the elasticity of the elastomer body as a function of a vibration frequency.

4. A holding device according to claim 3, wherein the electric control is configured and/or programmed such that the electric control varies the elasticity of the elastomer body in at least two steps or makes possible a stepless adaptation of the elasticity to the vibration frequency.

5. A holding device according to claim 3, wherein the control is configured and/or programmed such that electric control varies the elasticity of the elastomer body with the vibration frequency.

6. A holding device according to claim 1, wherein the coupling device comprises at least one dilatant material for movement transmission between the connecting points.

7. A holding device according to claim 6, wherein the coupling device comprises a piston-cylinder unit including a cylinder connected to the first connecting point in a fixed manner and a piston connected to the second connecting point in a fixed manner, wherein the dilatant material is arranged in a working space of the cylinder, in which the piston is adjustable.

8. A holding device according to claim 6, wherein the dilatant material is formed into an elastomer body.

9. A holding device according to claim 8, wherein the elastomer body comprises at least one spring element acting in parallel with the dilatant material.

10. A holding device according to claim 1 wherein the coupling device comprises at least one flexurally-elastic sheet metal part, wherein the sheet metal part comprises at least one closed hollow space in which a free-flowing granulate is arranged, wherein the volume filled by the granulate is smaller than the total volume of the hollow space.

11. A holding device according to claim 10, wherein the sheet metal part at least in the region of the respective hollow space is configured as double sheet metal structure, wherein each individual sheet of the double sheet metal structure has a depression, which complement one another mirror-symmetrically to the respective hollow space.

12. A holding device for the holding of a component part of an exhaust system on a vehicle equipped with the exhaust system, the holding device comprising:

a first connecting point for fastening the holding device to the component part of the exhaust system;

a second connecting point for fastening the holding device to a structure;

a coupling device arranged between the connecting points, wherein the coupling device makes possible reversible relative movements between the connecting points, the coupling device having a speed-dependent and/or frequency-dependent stiffness in at least one active direction to provide the coupling device with having a lower stiffness with slower or low-frequency relative movements than with faster or high-frequency relative movements an elastomer body consisting of an electroactive polymer having an elasticity that is variable through the application of an electric voltage; and an electric control circuit having a control and being connected to the elastomer body for varying of the elasticity of the elastomer body as a function of a vibration frequency, wherein the control is configured and/or programmed such that the elasticity vibrations relative to the component part vibrations are phase-shifted to the extent that a reduction of the vibration amplitudes on the component part materializes.

13. A holding device for the holding of a component part of an exhaust system on a vehicle equipped with the exhaust system, the holding device comprising:

a first connecting point for fastening the holding device to the component part of the exhaust system;

a second connecting point for fastening the holding device to a structure; and a coupling device arranged between the connecting points and permitting reversible relative movements between the connecting points, wherein the coupling device comprises an electric actuator and an electric control circuit connected to the electric actuator, the electric control circuit comprising a vibration sensor for sensing vibrations of the component part and a control for actuating the actuator as a function of a vibration frequency determined based on the sensing of vibrations by the vibration sensor, the actuator being actuated by the electric control circuit to change a spacing between the connecting points, said control circuit being configured and/or programmed such that the control excites the actuator to actuator vibrations with the vibration frequency, wherein the actuator vibrations with respect to the component part vibrations are phase-shifted to provide a reduction of the vibration amplitudes on the component part.

14. A holding device according to claim 13, wherein the actuator comprises an electroactive polymer the electroactive polymer changing in shape upon the application of an electric voltage thereto.

15. A holding device according to claim 1, wherein the at least one active direction of the coupling device is oriented parallel to a heat expansion direction in which the respective component part moves relative to the structure because of thermal heat expansion.

16. A holding device according to claim 13, wherein the at least one active direction of the coupling device is oriented parallel to a heat expansion direction in which the respective component part moves relative to the structure because of thermal heat expansion.

17. An exhaust system for a combustion engine, comprising:

a component part of the exhaust system;

a peripheral structure; and a holding device comprising:

a first connecting point for fastening the holding device to the component part of the exhaust system;

a second connecting point for fastening the holding device to the peripheral structure; and a coupling device arranged between the connecting points and permitting reversible relative movements between the connecting points, wherein the coupling device comprises an electric actuator and an electric control circuit connected to the electric actuator, the electric control circuit comprising a vibration sensor for sensing vibrations of the component part and a control for actuating the actuator as a function of a vibration frequency determined based on the sensing of vibrations by the vibration sensor, the actuator being actuated by the electric control circuit to change a spacing between the connecting points, said control circuit being configured and/or programmed such that the control excites the actuator to actuator vibrations with the vibration frequency, wherein the actuator vibrations with respect to the component part vibrations are phase-shifted to provide a reduction of the vibration amplitudes on the component part.

* * * * *